United States Patent [19]

Hunter

[11] Patent Number: 4,508,587

[45] Date of Patent: Apr. 2, 1985

[54] MASKING PAPER AND TAPE DISPENSER

[76] Inventor: Travis L. Hunter, 652 Juniper, Upland, Calif. 91786

[21] Appl. No.: 546,362

[22] Filed: Oct. 27, 1983

[51] Int. Cl.[3] ..... B32B 31/00

[52] U.S. Cl. ..... 156/527; 156/554; 156/577; 156/579

[58] Field of Search ..... 156/523, 527, 574, 577, 156/579, 544, 554

[56] References Cited

U.S. PATENT DOCUMENTS

| | | | |
|---|---|---|---|
| Re. 14,276 | 3/1917 | MacLaurin | 156/523 |
| 3,127,299 | 3/1964 | Hecht | 156/579 |
| 3,553,060 | 1/1971 | Waltz | 156/554 |
| 3,950,214 | 4/1976 | Pool et al. | 156/577 |
| 4,096,021 | 6/1978 | Pool et al. | 156/577 |
| 4,379,019 | 4/1983 | Pool | 156/527 |

*Primary Examiner*—Michael G. Wityshyn

*Attorney, Agent, or Firm*—Jackson, Jones & Price

[57] ABSTRACT

A tape and paper dispensing apparatus which has a C-shaped tubular frame and handle combination to which are also mounted a bracket for the tape and paper roller drums and a bracket for the cutting blade. The frame doubles as a handle and is made more stable by the placement of a thumbrest bracket on the tubular handle/frame. A depressor bar is spring biased to contact the point of adhesion of the tape to the paper on the paper roll and has a pressure applying foot which assists in insuring proper adhesion. The position of the end of the paper roller drum relative to a tape dispensing path is adjustable.

5 Claims, 4 Drawing Figures

FIG. 1
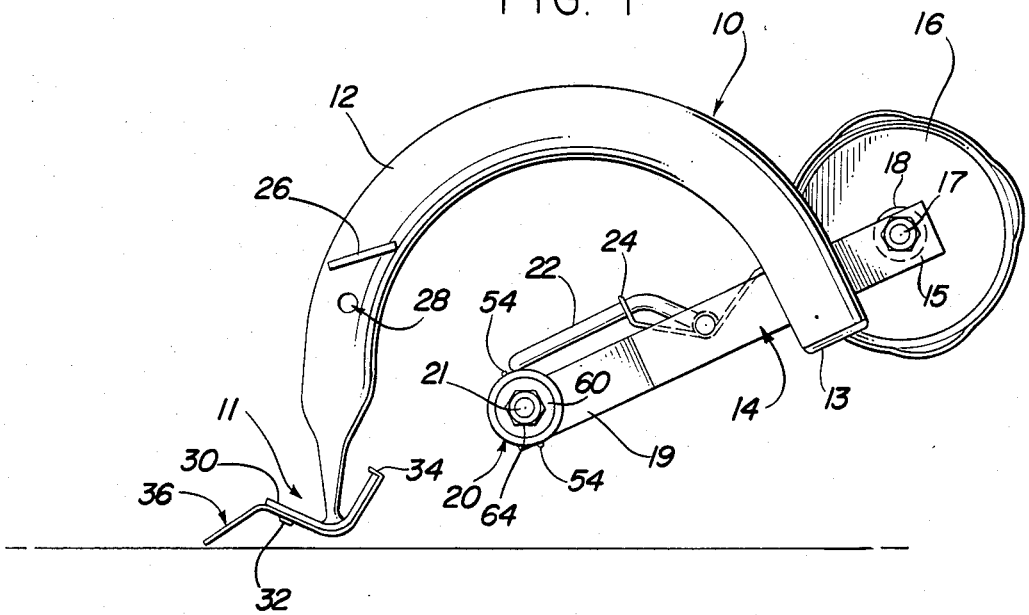
FIG. 2
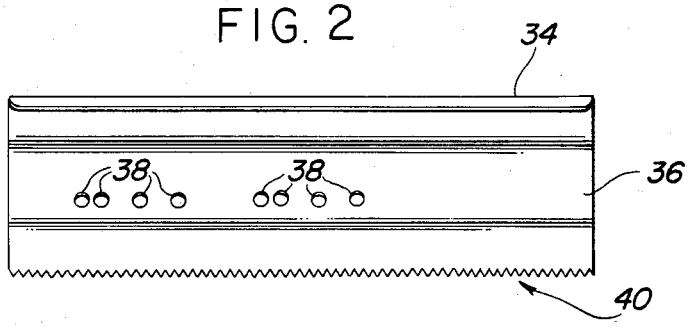
FIG. 3
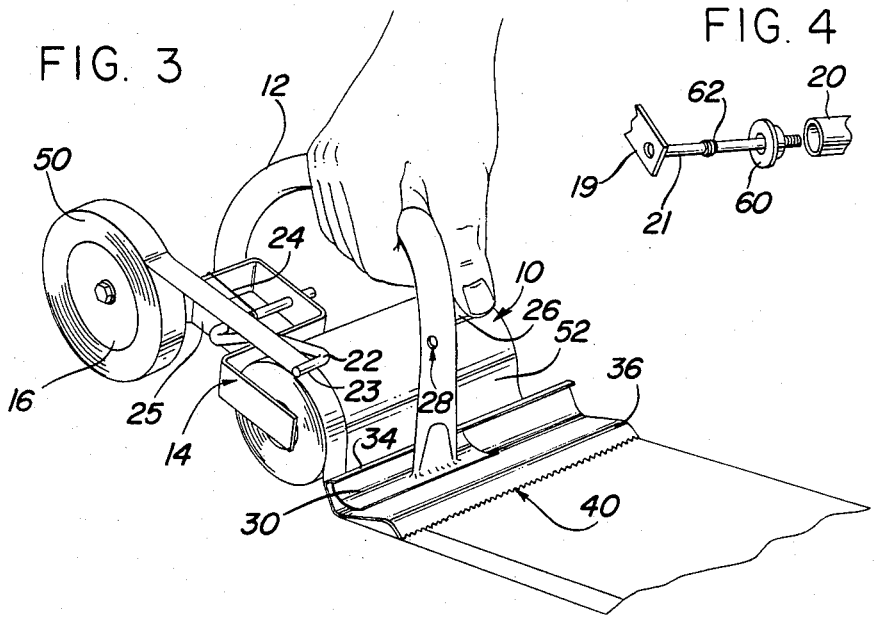
FIG. 4

MASKING PAPER AND TAPE DISPENSER

FIELD OF THE INVENTION

The present invention relates to the field of hand-held masking machines in which paper is dispensed with a border of masking tape with the tape extending over the edge of the paper so as to be readily applicable to a surface to be masked.

BACKGROUND AND SUMMARY OF THE INVENTION

In the past it has been common to dispense masking paper and masking tape simultaneously with the tape extending over the edge of the paper so as to be readily applicable to a surface to be masked as the paper is dispensed. Examples of such prior art apparatus may be seen in the patents to Poole et al., U.S. Pat. Nos. 3,950,214 and 4,096,021. The prior art apparatus which dispensed masking paper with a tape border typically contained a frame to which a grasping handle is attached for grasping the machine with one hand. The handle of such apparatus is formed separately of the frame. Such apparatus could tend to twist in the hand of the operator, causing the tape to become separated from the surface to which the tape and masking paper is being applied. This problem is particularly applicable to the apparatus shown in the above-referenced Poole et al. U.S. Pat. No. 4,096,021 wherein the handle is shown to be mounted on an arm attached to the side of the frame such that even if the handle itself does not twist in the hand of the operator, the moment force created by grasping the handle during the operation of the machine could tend to twist the frame to separate the tape from the surface being masked during application.

It is additionally a problem in the art in ensuring that the tape adhesively attaches to the paper as the paper and tape are played out by moving the machine in relation to a surface being masked. Early apparatus in the art relied simply playing out of the tape and paper together after the tape had once been affixed to a portion of the paper. Subsequent apparatus including those shown in the Poole et al. patents, as mentioned above, have employed a variety of auxiliary rollers to ensure that the paper and tape are adhesively joined as the paper is played out from the machine. These auxiliary rollers contribute to the complexity and cost of manufacture of the machine.

Furthermore, it is often desirable to be able to adjust the relative amount of tape contacting the paper to tape extending over the edge of the paper, and this has not been adequately provided for in the prior art.

Thus, while the arrangements of the prior art have exhibited a degree of utility in providing for the concurrent dispensing of masking paper and tape such that the tape extends over the edge of the paper to facilitate application to a surface to be masked, room for significant improvement remains. The problems enumerated in the foregoing are not intended to be exhaustive, but are rather among many which tend to impair the effectiveness of previously-known masking paper and tape dispensers. Other noteworthy problems may also exist; however, those presented above should be sufficient to demonstrate that masking paper and tape dispensers appearing in the prior art have not been altogether satisfactory.

Recognizing the need for an improved masking paper and tape dispenser, it is, therefore, a general object of the present invention to provide a novel masking paper and tape dispenser which minimizes or reduces the problems of the type previously noted. It is a more particular feature of the present invention that the frame of the masking paper and tape dispensing machine of the present invention is formed into a generally C-shaped frame member having a first end and a second end and a central gripping portion, with the paper and tape dispensing rollers being mounted on a bracket attached to one end of the frame and a cutting blade attached to the other.

It is a further feature of the present invention that the bracket has pivotally attached thereto a depressor bar, with the end of the depressor bar forming a pressure-applyin foot which is spring biased into contact with the paper contained on the paper dispensing roll in the region where the tape contacts the paper before the paper is played off of the paper dispensing roll.

Another feature of the present invention provides for adjusting the position of the paper-containing roll by laterally adjusting the position of the paper dispensing roller drum, on which the paper dispensing roll is placed, with respect to the position of the tape dispensing roll to selectively position the tape relative to the edge of the paper on the paper dispensing roll, thereby adjusting the relative portion of the tape which is contacting the paper as opposed to extending over the edge of the paper.

Examples of the more important features of the present invention have thus been summarized rather broadly in order that the detailed description thereof that follows may be better understood, and in order that the contribution to the art may be better appreciated. There are, of course, additional features of the invention that will be described hereinafter and which will form the subject of the appended claims. These other features and advantages of the present invention will become apparent with reference to the following detailed description of a preferred embodiment thereof in connection with the accompanying drawings, wherein like reference numerals have been applied to like elements, in which:

BRIEF DESCRIPTION OF THE DRAWINGS

FIG. 1 shows a side view of the masking paper and tape dispenser of the present invention without the paper-containing roll or tape-containing roll mounted on the respective roller drums for each;

FIG. 2 shows a cutting blade adapted for being mounted on the machine shown in FIG. 1 in a plurality of different positions;

FIG. 3 is a perspective view of the apparatus of FIG. 1 showing the positioning of the hand and thumb of the operator and the paper-containing and tape-containing rolls in place; and FIG. 4 is a detailed exploded view of a portion of the apparatus shown in FIGS. 1 and 3 which illustrates the manner in which the position of the paper-containing roll is adjustable with respect to the position of the tape-containing roll to thereby adjust the relative portion of the tape contacting the paper as opposed to extending over the edge of the paper as the tape and paper are dispensed.

DETAILED DESCRIPTION OF A PREFERRED EMBODIMENT OF THE INVENTION

Turning now to FIG. 1, the masking paper and tape dispenser according to the present invention is shown which is designated generally as 10. The dispenser 10 has a combination frame and handle structure formed by a bent metal tube 12 which has one end rolled flat to form a flattened portion 11, and has a plastic cap 13 covering the opposite end to smooth the metal edges of the hollow tube 12 and prevent, for example, scratching of a surface to which masking paper and tape is being applied. A roller mounting bracket 14 is mounted by any suitable means, for example, by welding to the handle frame 12 at generally the end containing the cap 13. The roller mounting bracket 14 is formed of a generally U-shaped piece of metal with uneven legs, one leg of which is bent to form a tape roller drum mounting 15. The tape roller drum 16 is rotatably mounted on a shaft 17 connected to the tape roller drum mounting portion 15 with a bushing 18 intermediate the tape roller drum mounting portion 15 and the tape roller drum 16. The other, longer, leg of the bracket 14 is bent to form a paper roller drum mounting portion 19 to which a paper roller drum 20 is rotatably mounted on a shaft 21 connected to the paper roller drum mounting portion 19, as is more fully described below with respect to FIG. 4.

A depressor bar 22 is pivotally mounted through a hole in the base portion of the U-shaped bracket 14 and a second hole in a cross-member 25 mounted between the straight portions of the legs of the U-shaped bracket 14 (as is more fully shown in FIG. 3). A spring 24 biases the depressor bar 22 into contact with the paper roller drum mounting.

Extending laterally to the side of the frame handle 12, forward of the center of the arc formed by the bent C-shaped tube, is attached a thumbrest tab 26. The thumbrest tab 26 may be a flat piece of metal mounted to the side of the tube 12. Also shown is a hole 28 drilled through the tube 12 to which may be mounted an auxiliary tape dispenser for containing an auxiliary roll of tape to be utilized by the operator as needed. Such an auxiliary tape dispenser is shown, for example, in the Hand Masker M-3X Dispenser manufactured by P. C. Manufacturing Corp. of Phoenix, Ariz., and is not shown in the figures for the present invention in order to simplify the illustration of the present invention. It will be understood that the piggyback tape dispenser described as sold by P.C. Manufacturing Corp. is made of a plastic material, however, such a construction could be mounted on a metal bracket attached to the frame 12 of the present invention by a nut passing through the hole 28.

Mounted by suitable means, e.g., welding, to the flattened portion 11 of the tube 12 is a cutting blade mounting bracket 30 forming generally an L-shape with the vertex of the L located at the position of the bracket 30 to which the flattened portion 11 is mounted.

Turning now to FIG. 2, a cutting blade 36 is shown, which is, as can be seen in FIG. 1, in a portion thereof also generally L-shaped. One end of the L is bent back to form a locking edge 34. A plurality of holes 38 contained in the cutting blade 36 are spaced apart on the cutting blade 36 so as to receive each of a pair of cutting blade mounting knobs 32 formed on the cutting blade mounting bracket 30 (shown in FIG. 1) so as to adjust the lateral position of the cutting blade 36. This facilitates adjusting the blade 36 to accommodate variations in the width of the masking tape contained on a roll of masking tape placed on the tape dispensing roller drum 16. The cutting blade 36 is further bent, as shown in FIG. 1, downwardly toward the working surface, with the terminal edge of the blade 36 forming a serrated cutting edge 40.

Turning now to FIG. 3, the completed dispenser 10 of the present invention is shown, in perspective view, in operation. A tape dispensing roll 50 is mounted on the tape roller drum 16 and a paper dispensing roll 52 is mounted on paper roller drum 20. Returning to FIG. 1, it will be seen that a pair of springs 54 extend outwardly from the surface of the paper roller drum 20 to more positively lock the paper roll 52 in position on the drum 20. The springs 54 may be formed by a thin metal bar, the opposite ends of which are bent to be inserted into a pair of holes (not shown) drilled in the cylindrical surface of the drum 20, leaving a portion of the bar extending outwardly from the surface of the drum 20 between the holes.

The tape from the tape roll 50 passes directly to the paper roll 52 without intervening guiding or pressure rollers, with both the paper roll 52 and the tape roll 50 rotating in the clockwise direction as shown in FIG. 3 during the dispensing. The depressor arm 22 is bent to form a pressure-applying foot 23 which rests on the surface of the paper-dispensing roll 52 at the position where the tape from the tape roll 50 first contacts the paper. This assists in ensuring that the tape will be properly adhered to the surface of the paper. It will be understood that the length of the bushing 18 is selected so that the tape-dispensing direction of the tape from the tape roll 50 will align the tape such that a portion of the tape at least extends to contact the edge of the paper on the roller 52. Thus, some portion of the tape will, as is desired, adhere to the paper, while the remainder extends over the edge of the paper on the roll 52.

Turning now to FIG. 4, there is shown a manner according to the present invention of finely selecting the relative proportion of the tape contacting the paper to the tape extending over the edge of the paper. The paper roller drum 20 is formed by a hollow tube connected to a bushing 60 which extends over the shaft 21, with a similar bushing 60 at the opposite end of the tube 20 (as shown in FIG. 1). A coil spring 62 is mounted intermediate the paper roller drum mounting portion 19 and the bushing 60 shown in FIG. 4. The coil spring 62 thus biases the bushing 60, tube 20 and opposite bushing 60 to the extent allowed by the adjustment of the position of a nut 64 at the opposite end of the shaft 21 (as shown in FIG. 1). It will be understood that two nuts 64 could be employed for locking purposes. It will further be understood that the length of the threaded area of the shaft 21 extending beyond the end of the bushing 60 shown in FIG. 1 provides for a degree of movement of the paper roller drum 20 in response to the urging of the spring 62 and the positioning of the nut or nuts 64. Thus, the relative position of the end of the drum 20 shown in FIG. 4 to the tape-dispensing path of the tape from the roller 50 may be adjusted as desired by the operator for varying paper and tape sizes and for varying jobs.

SUMMARY OF THE ADVANTAGES AND SCOPE OF THE INVENTION

It will be appreciated that in constructing a masking paper and tape dispenser according to the present invention certain significant advantages are provided. In particular, the C-shaped tubular combination frame and handle construction is simple to manufacture and easy for the operator to grasp in the hand, with the lateral thumb tab 26 adding stability for one-handed operation of the dispenser 10 of the present invention. In addition, the combination of the removal of intervening pressure or guidance rollers between the tape dispenser roll 50 and the paper roll 52 simplifies the construction and operation of the machine with the pressure-applying foot 23 serving to ensure adhesion of the tape from the tape roll 50 to the paper from the paper roll 52 as the paper and tape are concurrently dispensed. Also, the ability to laterally adjust the position of the paper roller drum allows for easy adjustment of the amount of tape contacting the paper in relation to the amount of tape extending over the edge of the paper.

The foregoing description of the invention has been directed to a particular preferred embodiment in accordance with the requirements of the patent statutes and for purposes of explanation and illustration. It will be apparent, however, to those skilled in this art, that many modifications and changes in both apparatus and method may be made without departing from the scope and spirit of the invention. These and other modifications of the invention will be apparent to those skilled in this art. It is the Applicant's intention in the following claims to cover all such equivalent modifications and variations as fall within the true spirit and scope of the invention.

What is claimed is:

1. A masking paper and tape dispensing machine comprising:

an elongated tubular frame member having a first end and a second end, the tubular frame member being curved and of such a dimension to directly provide a central hand-grip consisting of a portion of the frame between the first and second ends;

a roller mounting bracket attached to the first end of the frame;

a paper roller drum having an axis of rotation attached to the mounting bracket and extending into the opening between the first and second ends of the frame;

a tape roller drum having an axis of rotation attached to the mounting bracket with the axis of rotation aligned with the axis of rotation of the paper roller and positioned such that the dispensing path of a roll of tape mounted on the tape roller drum is aligned with generally one end of the paper roller drum;

a blade mounting bracket attached to the second end of the frame; and a blade mounted on the blade mounting bracket and having a blade edge aligned with the axis of the paper roller drum.

2. The apparatus of claim 1, further comprising:

a depressor bar pivotally mounted on the roller-mounting bracket and having a pressure-applying foot extending in alignment with the axis of the paper roller drum and across the tape dispensing path; and a biasing spring for biasing the pressure-applying foot into contact with tape dispensed from a tape roll mounted on the tape roller drum in the region of contact between the tape and the surface of a sheet of paper rolled in a roll of paper mounted on the paper roller drum.

3. The apparatus of claim 1, further comprising:

a thumbrest bracket attached to the frame in a position to receive the thumb of a user grasping the frame by the hand grip of the frame.

4. The apparatus of claim 3, further comprising:

a depressor bar pivotally mounted on the roller-mounting bracket and having a pressure-applying foot extending in alignment with the axis of the paper roller drum and across the tape dispensing path; and a biasing spring for biasing the pressure-applying foot into contact with tape dispensed from a tape roll mounted on the tape roller drum in the region of contact between the tape and the surface of a sheet of paper rolled in a roll of paper mounted on the paper roller drum.

5. The apparatus of claim 1 wherein the mounting of the paper roller drum to the roller mounting bracket further comprises:

a shaft of a greater length than the paper roller drum;

a coil spring positioned between the paper roller drum and the bracket, urging the paper roller drum away from the bracket; and a selectively adjustable stop member operatively connected to the shaft to form a selectively adjustable stop which selectively adjusts the distance to which the coil spring urges the paper roller drum away from the roller mounting bracket.

* * * * *